US007461469B2

(12) United States Patent
McClaskie

(10) Patent No.: US 7,461,469 B2
(45) Date of Patent: Dec. 9, 2008

(54) SHOE WITH IMPROVED OPANKA CONSTRUCTION

(75) Inventor: Thomas E. McClaskie, Bethlehem, PA (US)

(73) Assignee: Columbia Insurance Company, Omaha, NE (US)

( * ) Notice: Subject to any disclaimer, the term of this patent is extended or adjusted under 35 U.S.C. 154(b) by 293 days.

(21) Appl. No.: 11/220,954

(22) Filed: Sep. 7, 2005

(65) Prior Publication Data

US 2007/0051017 A1 Mar. 8, 2007

(51) Int. Cl.
*A43B 3/12* (2006.01)

(52) U.S. Cl. ..... 36/11.5; 36/19 R; 36/23; 12/142 B

(58) Field of Classification Search ..... 36/11.5, 36/19 R, 19 A, 21, 22 R, 23, 11
See application file for complete search history.

(56) References Cited

U.S. PATENT DOCUMENTS

| | | | | | |
|---|---|---|---|---|---|
| 45,138 | A | * | 11/1864 | Closs | 12/142 B |
| 318,878 | A | * | 5/1885 | Day | 36/22 R |
| 1,922,430 | A | | 8/1933 | Game | |
| 2,037,970 | A | * | 4/1936 | Everston | 36/19 R |
| 2,163,158 | A | * | 6/1939 | Schroder | 36/19 R |
| 2,220,555 | A | * | 11/1940 | Stritter | 36/19 R |
| 2,565,662 | A | * | 8/1951 | McMahon | 36/19 R |
| 2,978,817 | A | * | 4/1961 | Brenner | 36/97 |
| 3,414,989 | A | * | 12/1968 | Odermatt | 36/14 |
| 3,629,961 | A | | 12/1971 | Seif | 36/2.5 |
| 3,821,827 | A | | 7/1974 | Nadler | 12/142 |
| 3,841,003 | A | | 10/1974 | Huyge | 36/11.5 |
| 3,890,725 | A | | 6/1975 | Lea et al. | 36/11.5 |
| 4,369,589 | A | | 1/1983 | Summey | 36/77 |
| 4,685,223 | A | * | 8/1987 | Long | 36/16 |
| 6,092,307 | A | * | 7/2000 | Singer et al. | 36/12 |
| 6,192,605 | B1 | | 2/2001 | Challant | 36/17 |
| 6,574,886 | B1 | | 6/2003 | Issler | 36/12 |
| 6,691,360 | B2 | | 2/2004 | Mukherjee et al. | 12/142 |
| 2004/0237341 | A1 | | 12/2004 | Issler | 36/25 |
| 2005/0016017 | A1 | | 1/2005 | McClaskie | 36/7.5 |
| 2005/0016022 | A1 | | 1/2005 | McClaskie | 36/30 |

* cited by examiner

*Primary Examiner*—Ted Kavanaugh
(74) *Attorney, Agent, or Firm*—St. Onge Steward Johnston & Reens LLC

(57) ABSTRACT

The invention relates to a shoe that has a socklining with a periphery, a sole with a periphery, an upper placed above the socklining and extending downwardly around the periphery of the socklining and between the socklining and the sole. The shoe further includes a stitch extending through the socklining, upper, and sole for securing the upper between the socklining and sole and where the stitch extends around the peripheries of both the socklining and sole.

17 Claims, 3 Drawing Sheets

SHOE WITH IMPROVED OPANKA CONSTRUCTION

FIELD OF THE INVENTION

The invention relates to a shoe with improved construction.

BACKGROUND OF THE INVENTION

A variety of different shoe constructions are typically used by the footwear industry. For the most part, each shoe construction has characteristics that make it particularly well-suited for specific applications. For example, some shoe constructions are selected for their durability, others for their flexibility and comfort, while still others are selected for their aesthetic appeal.

In general, shoe construction typically involves a number of manufacturing operations, or steps. Normally, a significant number of manufacturing operations generally results in a more expensive shoe. In a market where competitive price is often desired, there appears to be a need to make shoes in an efficient manner. Conventionally, a shoe construction may involve an upper being stitched to a forepart of an outsole by a hand stitch and the rearpart of the outsole may be attached to the upper by adhesive after a lasting operation. Lasting is typically where a last, an object which simulates a user's foot, is inserted into the upper and the upper is often then pulled taught around the last and secured to a tuck, which is removably attached to the bottom of the last. The tuck generally provides a structure that is adhered to the rearpart of the outsole, which in turn results in the upper being secured to the outsole in the rearpart of the shoe. Without a tuck, it may be difficult to secure the upper to the outsole.

A traditional insole is often wrapped with a wrapper around its peripheral edge to help prevent the edge of the insole from wear. The insole with the wrapper is then typically secured to the tuck or outsole. In a separate operation, a socklining may then be adhered directly to the top of the insole for providing a surface adapted to receive a user's foot because the insole's surface is often coarse.

Cementing is another shoe construction and often involves a number of manufacturing operations. Cementing components of a shoe, such as the upper to the outsole, typically involves a surface preparation step where the surfaces to be cemented, or glued, are clean of debris and readied, which may also include roughening. Further, there may be an application step where the cement is applied to the surfaces. This step may also involve measuring and evenly distributing the glue over the surface.

Further, there may be a pressing step where the surfaces are pressed together. Pressing is believed to reduce air that may be trapped between the surfaces and enhances adhesion. Pressing may also include aligning the surfaces so that the peripheries of the components are flush with one another.

Additionally, once the components are pressed together, cementing often requires a waiting period for the cement to cure, or dry. Generally, not only does cementing involve some or all of the above mentioned manufacturing operations, it also involves time, particularly the curing time. Another disadvantage of cementing may be that the shoe suffers from a lack of flexibility due to the cement itself, which is typically a dry, brittle, and possibly hardened mass. Moreover, cement adds weight and bulk to the shoe.

The number of steps and time involved, especially if user intervention is required, usually increases the cost of making the shoe and reduces manufacturing efficiency. The cementing process may be further complicated if the surfaces to be glued are uneven or difficult to reach.

U.S. Pat. No. 3,841,003 to Huyge ("Huyge") appears to disclose an upper placed between a footbed and outsole and further teaches that the upper may be stitched to a base member, which is also placed between the footbed and outsole. However, the stitch does not seem to secure the footbed, upper, and outsole together. See col. 2, lines 48-49. Moreover, the reference does not seem to disclose a handsewn stitch or stitch that extends around the entire periphery. In fact, the footbed is taught to be cemented to the base member. See col. 2, lines 39-41.

U.S. Pat. No. 4,369,589 to Summey ("Summey") and U.S. Pat. No. 3,821,827 to Nadler ("Nadler") appear to disclose a shoe having cement or glue to secure the upper to the midsole or outsole. Summey seems to disclose the pressing and aligning operations as well as user intervention described above.

U.S. Pat. No. 6,192,605 to Challant ("Challant") appears to disclose an upper, footbed, and outsole mechanically sewn together where the upper is between the footbed and outsole. See col. 3, lines 18-22. However, the reference does not seem to disclose a handsewn stitch or a stitch that extends around the entire periphery.

U.S. Pat. No. 1,922,430 to Game ("Game") seems to show an upper placed between a footbed and outsole but is not taught to be stitched in this position nor is stitching shown to extend around the entire periphery.

What is desired, therefore, is a shoe that may be constructed in a more efficient manner, including reduced manufacturing costs and less manufacturing operations. What is also desired is a shoe that is efficiently manufactured without sacrificing aesthetic appeal. A further desire is a shoe having enhanced flexibility.

SUMMARY OF THE INVENTION

It is therefore an object of the invention to provide a shoe with reduced manufacturing costs and less manufacturing operations.

Another desire is a shoe with enhanced flexibility without sacrificing durability.

These and other objects of the invention are achieved by a shoe that has a socklining with a periphery, a sole with a periphery, an upper placed above the socklining and extending downwardly around the periphery of the socklining and between the socklining and the sole. The shoe further includes A stitch extending through the socklining, upper, and sole for securing the upper between the socklining and sole and where the stitch extends around the peripheries of both the socklining and sole.

The stitch is handsewn and, in some embodiments, is an Opanka stitch. The stitch secures the upper between the socklining and sole without any other securing mechanism. In an embodiment, the upper extends over a portion of the socklining for defining a sandal.

In some embodiments, the sole is an outsole. In other embodiments, the sole is a midsole. In some of these embodiments, the socklining indirectly receives a user's foot. In further embodiments, the socklining directly receives a user's foot.

In a more particular aspect of the invention, the sole includes a recess and tread attachable to the sole includes a protrusion for mating with the recess. In some of these embodiments, the recess is a shape having at least three sides and the protrusion likewise is a shape that conforms in size and shape with the recess, including having a similar number of sides. The tread provides a walking surface for the shoe.

DETAILED DESCRIPTION OF THE DRAWINGS

Figure 1:
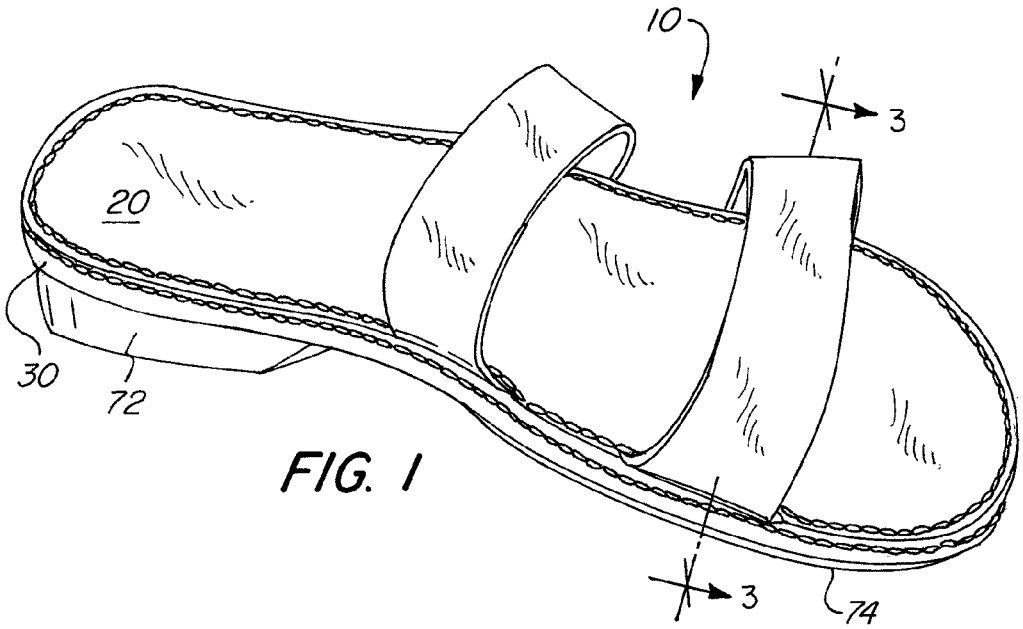
FIG. 1 depicts the shoe in accordance with the invention.

FIG. 1 depicts shoe 10 in accordance with the invention. As shown, shoe 10 includes socklining 20, sole 30, upper 40, and stitch 50 for securing extension 42 of upper 40 between socklining 20 and sole 30. Stitch 50 secures extension 42 in direct contact with both socklining 20 and sole 30. The location of extension 42 within and between socklining 20 and sole 30 improves the aesthetic appearance of shoe 10, giving it a clean look where any excess of upper material, or the material extending beyond stitch 50, is hidden underneath socklining 20. As shown, upper 40 extends over a portion of socklining 20 wherein a sandal is defined.

Moreover, stitch 50 extends around an entire periphery of shoe 10, including the peripheries of socklining 20 and sole 30. As shown more particularly in FIG. 2, stitch 50 is handsewn. In further embodiments, stitch 50 is an Opanka stitch, which means a handsewn stitch. Moreover, the stitch secures upper 40 in contact with sole 30 without a lasting step or where upper material is wiped around a tuck. Also as shown, stitch 50 secures socklining 20, extension 42, and sole 30 without any other securing mechanism, such as adhesive, cement, tacks, rivets, fasteners, screws, and the like.

Figure 3:
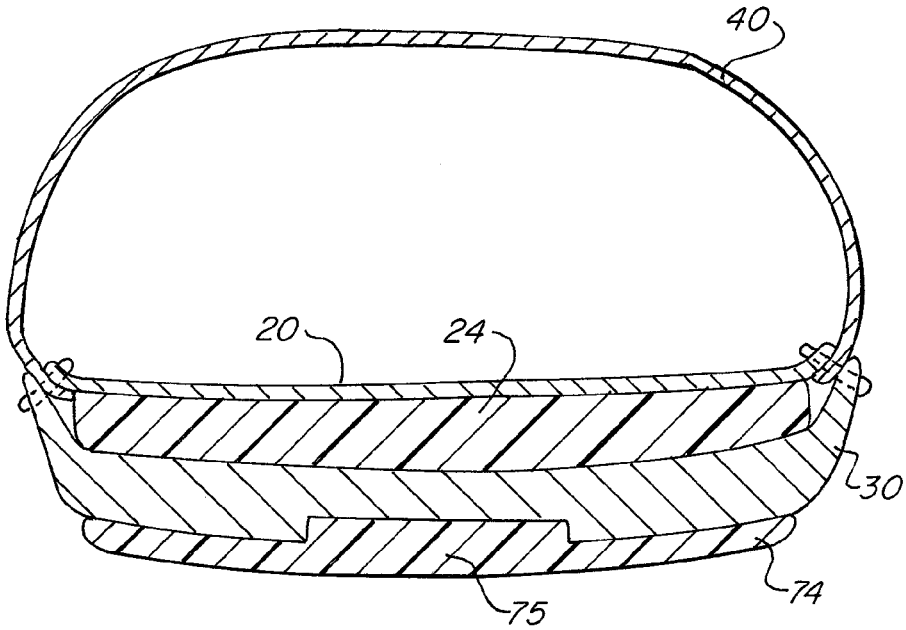
FIG. 3 depicts a cross sectional view of the shoe shown in FIG. 1.
Figure 2:
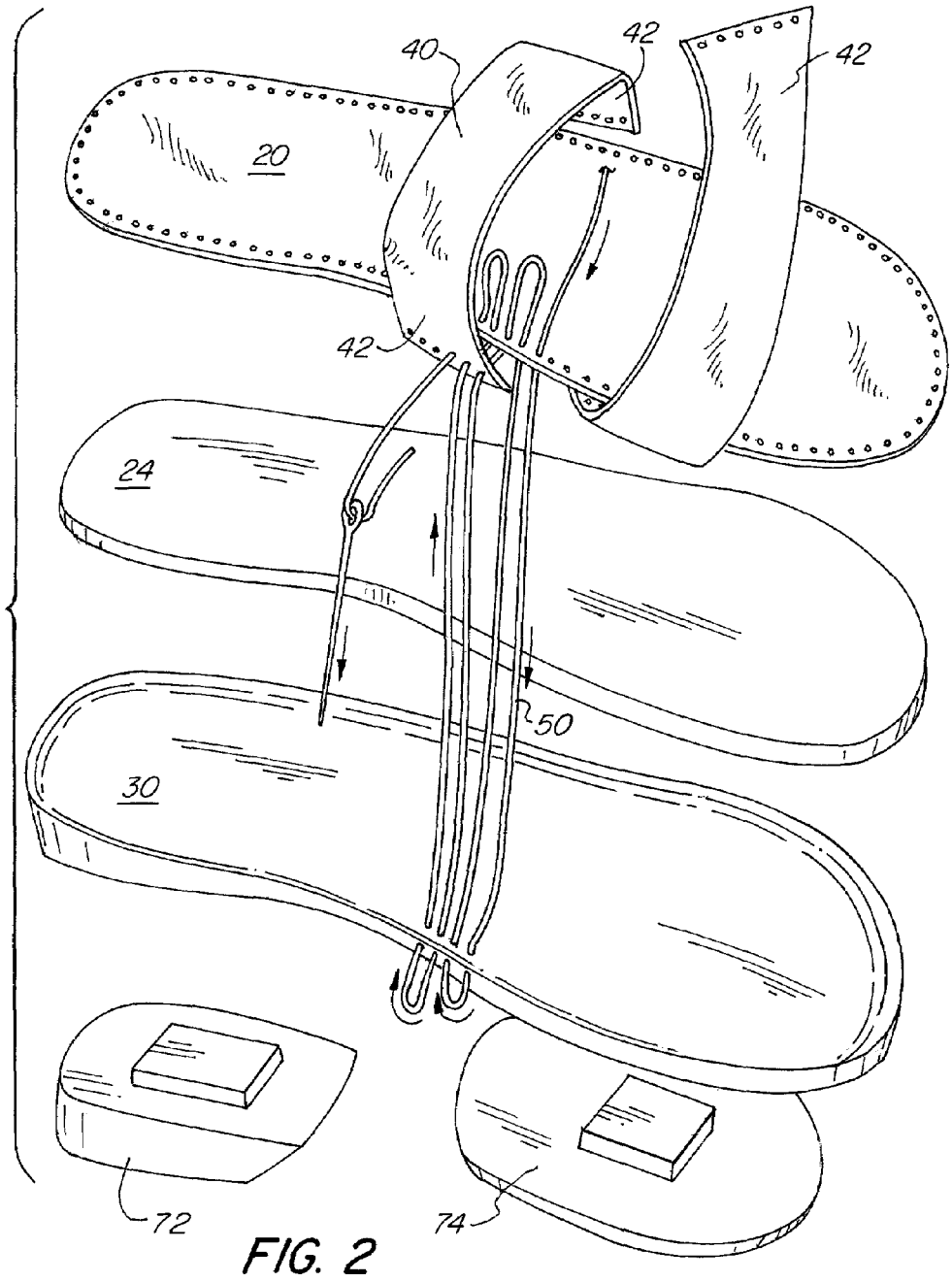
FIG. 2 depicts an exploded view of the shoe shown in FIG. 1.

As shown in FIGS. 1-3, sole 30 is an outsole. In other embodiments, sole 30 is a midsole where an outsole would then be attached to the bottom of the midsole. In further embodiments, sole 30 is an insole or tuckboard. In either situation, stitch 50 would be a sole securing mechanism for securing sole 30, extension 42, and socklining 20 together. Socklining 20 is any covering adapted to receive a user's foot, whether directly where the foot comes in direct contact with socklining 20 or indirectly where the foot rests upon another structure, such as an orthodic or cushion, that is on top of socklining 20. Socklining 20 is generally a soft, smooth material that is comfortable for receiving a foot, such as leather, vinyl, cotton, canvas, and the like. As shown, socklining 20 is a single unit of leather, although socklining 20 is not limited to being a single unit. Moreover, socklining 20 may also be padded in order to enhance comfort.

Optionally, and in addition to or instead of any padding socklining 20 may inherently provide, cushion 24 is also placed between socklining 20 and sole 30 but is not secured by stitch 50. Cushion 24 may be placed either on top of or below extension 42.

Figure 4:
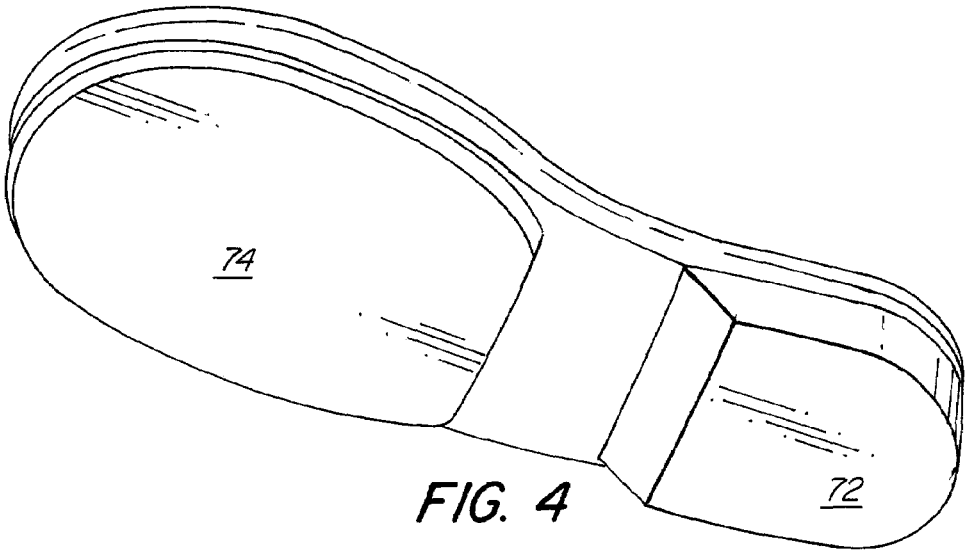
FIGS. 4 and 5 more particularly depict the sole and walking surface shown in FIG. 1.
Figure 5:
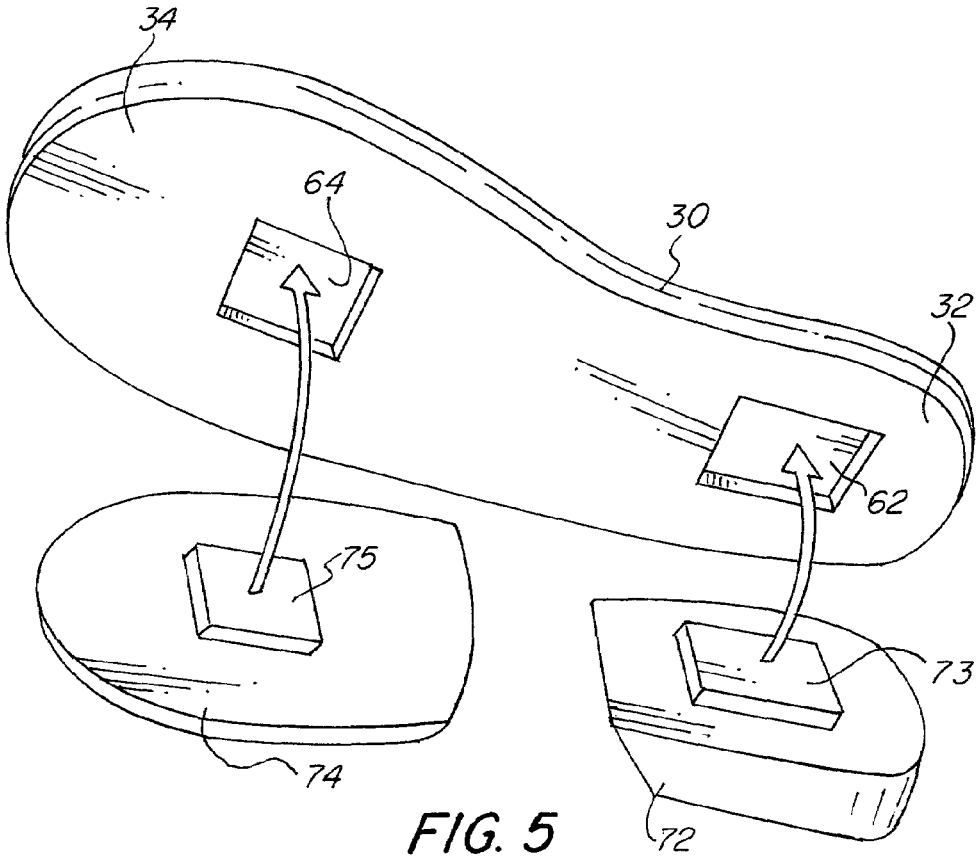

As shown in FIGS. 4-5, sole 30 includes heel recess 62 in heel region 32 and fore recess 64 in fore region 34, where recesses 62, 64 have at least three sides protrusions of heel tread 72 and fore tread 74 also have at least three sides to be consistent with the recess to which each protrusion corresponds. Moreover, each protrusion conforms in shape and size with the respective recess. In this manner, each protrusion mates with its respective recesses so that the protrusion would be inhibited from rotating relative to the recess. Because each protrusion would be inhibited from rotation, heel read 72 and fore tread 74 would also be inhibited from rotation as well. Therefore, each protrusion would not only be placed in the proper location along the surface of sole 30 but would also be in proper rotational position.

It should be known that each recess need not be the same. For example, heel recess 62 may be four sided and fore recess 64 may be five sided. All that is required is that the corresponding protrusion be consistent in shape, size, and number of sides as the recess to which it mates. Continuing with the above example, protrusion 73 of heel tread 72 would be four sided and protrusion 75 of fore tread 74 would be five sided. Moreover, the size and shape of the protrusion would be consistent with that of the recess. For example, a three sided protrusion that is much smaller than the three sided recess into which it is inserted would not likely inhibit rotation of the protrusion. The sides of the protrusion should come in contact, when rotated, with the sides of the recess in order to reduce rotation. It is understood that the recess and protrusion may be of any shape, such as a square, triangle, or any polygonal shape provided the shape of the protrusion mates with the shape of the recess.

Both heel tread 72 and fore tread 74 provide a walking surface for shoe 10 and are generally made of wear resistant material because treads 72, 74 come in direct contact with the ground. In some embodiments, heel tread 72 is incorporated into heel 70. Once protrusions 73, 75 are mated with recesses 62, 64, cement or fasteners may be used to secure treads 72, 74 to sole 30. In other embodiments, a walking surface would be integrally attached to sole 30, in which case the operation for attaching treads 72, 74 would be obviated.

What is claimed is:

1. A sandal comprising:

a socklining having a periphery;

a sole having a periphery;

an upper placed above said socklining and extending downwardly around said periphery of said socklining and between said socklining and said sole;

said upper extends over only a portion of said periphery of said sole and of said socklining for defining a sandal;

a stitch extending through said socklining, upper, and sole for securing said upper between said socklining and said sole without any other securing mechanism;

said stitch is a sole securing mechanism in the shoe for securing said upper between said socklining and said sole; and said stitch extends around said peripheries of said socklining and said sole.

2. The shoe according to claim 1, wherein said stitch is handsewn.

3. The shoe according to claim 1, wherein said stitch is an Opanka stitch.

4. The shoe according to claim 1, wherein said sole is a midsole.

5. The shoe according to claim 1, wherein said socklining indirectly receives a user's foot.

6. The shoe according to claim 1, wherein said socklining directly receives a user's foot.

7. The shoe according to claim 1, wherein said sole further includes a recess.

8. The shoe according to claim 7, wherein said recess is a shape having at least three sides.

9. The shoe according to claim 1, further comprising a tread attached to said sole for providing a walking surface.

10. The shoe according to claim 9, wherein said sole further includes a recess and said tread further includes a protrusion for mating with said recess.

11. The shoe according to claim 8, further comprising a tread attached to said sole for providing a walking surface, said tread further includes a protrusion having a shape with at least three sides for mating with said recess.

12. A sandal comprising:

a sole having a periphery;

an upper extending over only a portion said periphery of of said sole to define a sandal;

said sole is placed above and attached to said sole;

a stitch extending through said upper and sole for securing said upper to said sole without any other securing mechanism;

said stitch is a sole securing mechanism for securing said upper between said socklining and said sole;

a tread attached to said sole for providing a walking surface;

said sole further includes a recess; and said tread further includes a protrusion for mating with said recess.

13. The shoe according to claim 12, wherein said recess is a shape having at least three sides.

14. The shoe according to claim 13, wherein said tread further includes a protrusion having a shape with at least three sides for mating with said recess.

15. The shoe in accordance with claim 12, further comprising a stitch extending through said upper and said sole for securing said upper to said sole, said stitch extends around an entire periphery of both said upper and said sole.

16. The shoe in accordance with claim 12, wherein said stitch is a handsewn stitch.

17. A sandal comprising:

a socklining having a periphery;

a sole having a periphery;

an upper placed above said socklining and extending downwardly around said periphery of said socklining and between said socklining and said sole;

said upper extends over only a portion of said periphery of said sole and of said socklining for defining a sandal;

a stitch extending through said socklining, upper, and sole for securing said upper between said socklining and said sole without any other securing mechanism; and said stitch is a sole securing mechanism for securing said upper between said socklining and said sole and is handsewn.

* * * * *